US006718947B1

(12) United States Patent
Mahr et al.

(10) Patent No.: US 6,718,947 B1
(45) Date of Patent: Apr. 13, 2004

(54) FUEL INJECTION METHOD AND SYSTEMS FOR AN INTERNAL COMBUSTION ENGINE

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 275 days.

(21) Appl. No.: 09/642,151

(22) Filed: Aug. 21, 2000

(30) Foreign Application Priority Data

Aug. 20, 1999 (DE) ..... 199 39 425

(51) Int. Cl.[7] ..... F02M 41/00
(52) U.S. Cl. ..... 123/447
(58) Field of Search ..... 123/447, 446, 123/445, 434

(56) References Cited

U.S. PATENT DOCUMENTS

| | | | | | |
|---|---|---|---|---|---|
| 5,619,969 | A | * | 4/1997 | Lin et al. | 123/447 |
| 5,622,152 | A | * | 4/1997 | Ishida | 123/446 |
| 5,732,679 | A | * | 3/1998 | Takahasi et al. | 123/467 |
| 5,906,188 | A | * | 5/1999 | Nakamura et al. | 123/464 |
| 6,092,509 | A | * | 7/2000 | Tanabe et al. | 123/447 |
| 6,112,721 | A | | 9/2000 | Kouketsu et al. | |

FOREIGN PATENT DOCUMENTS

JP WO 98/09068 3/1998

* cited by examiner

*Primary Examiner*—Bibhu Mohanty
(74) *Attorney, Agent, or Firm*—Ronald E. Greigg

(57) ABSTRACT

A method for injecting fuel at at least two different high fuel pressures via injectors into the combustion chamber of an internal combustion engine. The fuel injection at the higher fuel pressure takes place by pressure-controlled features, during the fuel injection, at least one lower fuel pressure is generated. To that end, a fuel injection system has one local diversion unit for each injector, and the diversion unit can be activated or deactivated via a valve unit.

14 Claims, 21 Drawing Sheets

FUEL INJECTION METHOD AND SYSTEMS FOR AN INTERNAL COMBUSTION ENGINE

BACKGROUND OF THE INVENTION

The invention is based on a fuel injection method and systems for an internal combustion engine as set forth hereinafter.

One such injection system has been disclosed by European Patent Disclosure EP 0 711 914 A1, for instance.

For the sake of better comprehension of the ensuing description, several terms will first be defined further: In a pressure-controlled fuel injection system, by means of the fuel pressure prevailing in the nozzle chamber of an injector, a valve body (such as a nozzle needle) is opened counter to the action of a closing force, and the injection opening is thus opened for an injection of the fuel. The pressure at which fuel emerges from the nozzle chamber into the cylinder is called the injection pressure. Within the scope of the invention, the term stroke-controlled fuel injection system is understood to mean that the opening and closure of the injection opening of an injector are accomplished with the aid of a displaceable valve member on the basis of the hydraulic cooperation of the fuel pressures in a nozzle chamber and in a control chamber. Furthermore, an arrangement will hereinafter be called central if it is intended for all the cylinders in common, and local if it is intended for only a single cylinder.

In the pressure-controlled fuel injection system known from EP 0 711 914 A1, with the aid of a high-pressure pump, fuel is compressed to a first, high fuel pressure of approximately 1200 bar and stored in a first pressure reservoir. The fuel at high pressure is also fed into a second pressure reservoir, in which a second high fuel pressure of about 400 bar is maintained by regulating the fuel delivery to the second pressure reservoir by means of a 2/2-way valve. Via a valve control unit, either the lower or the higher fuel pressure is introduced into the nozzle chamber of an injector. There, a spring-loaded valve body is lifted from the valve seat by the pressure, so that fuel can emerge from the nozzle opening.

A disadvantage of this known fuel injection system is that first all the fuel has to be compressed to the higher pressure level before some of the fuel can then be relieved to a lower pressure level and stored in a further pressure reservoir. Furthermore, two pressure reservoirs are required in order to store the two fuel pressures.

From International Patent Disclosure WO98/09068, a stroke-controlled injection system is also known, in which again two pressure reservoirs for storing the two fuel pressures are provided. For each pressure reservoir, its own high-pressure pump is provided, which is constantly in operation, specifically including whenever the desired pressure has already built up in the applicable pressure reservoir.

OBJECT AND SUMMARY OF THE INVENTION

To improve the injection performance and the efficiency, according to the invention, the injection method of the fuel injection systems are set forth. Refinements according to the invention are recited in the disclosure hereinafter.

According to the invention, it is proposed that a lower pressure level be generated during the applicable injection cycle, for instance by means of a local diversion unit or a piezoelectric valve unit. Since these units are independent of the camshaft, they could be in a targeted way as needed.

Losses from friction can also be reduced by means of a pressure step-up means that is not permanently in operation.

Further advantages and advantageous refinements of the subject of the invention can be learned from the description, drawing and claims.

Various exemplary embodiments of fuel injection systems according to the invention with a central distributor device, in which fuel is injected at two different high fuel pressures are shown schematically in the drawing and described in further detail below.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1A:
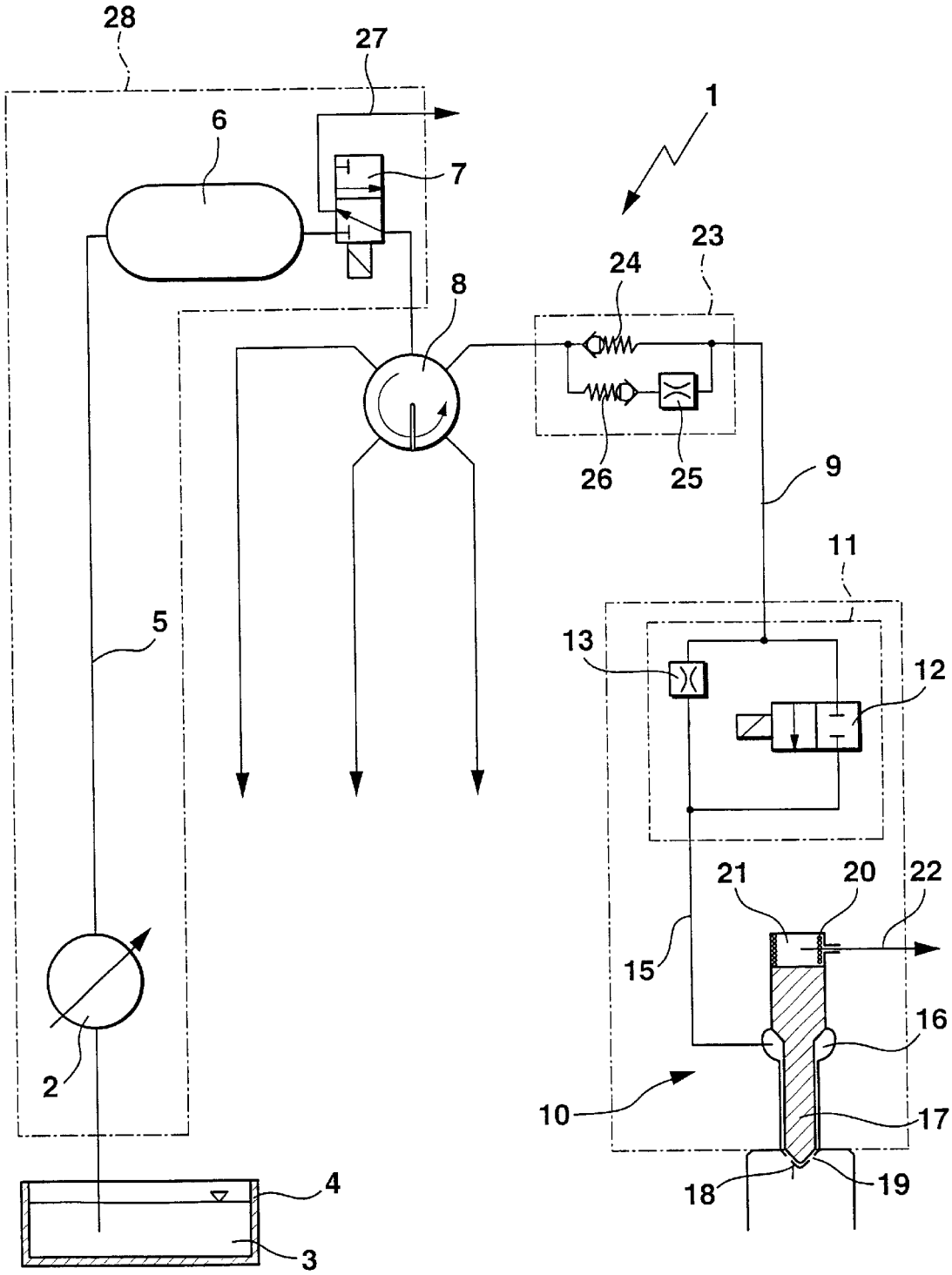
FIGS. 1*a* and 1*b* illustrate a first fuel injection system with pressure-controlled injectors and a locally dissipated generation of the lower fuel pressure.

In the first exemplary embodiment, shown in FIG. 1*a*, of a pressure-controlled fuel injection system 1, a quantity-controlled high-pressure pump 2 pumps fuel 3 from a tank 4 at high pressure via a feed line 5 into a central pressure reservoir 6 (high-pressure common rail). Under the control of a central valve unit 7 (such as a 3/2-way valve), the fuel is distributed from the pressure reservoir 6 centrally via a distributor device 8 to a plurality of high-pressure lines 9, corresponding in number to the number of cylinders, that lead to the individual injectors 10 (injection devices) that protrude into the combustion chamber of the internal combustion engine to be supplied. In FIG. 1*a*, only one of the injectors 10 is shown in detail. A first, higher fuel pressure of approximately 300 bar to 1800 bar can be stored in the pressure reservoir 6.

From the higher fuel pressure, a second, lower fuel pressure can be generated dissipatively for each injector 10 via a local diversion unit 11. In the exemplary embodiment shown, the local diversion unit 11 to that end includes a valve unit (such as a 2/2-way valve) 12, with which the higher fuel pressure can be either switched through or lowered, via a throttle 13, to the lower fuel pressure. Whichever pressure then prevails is carried via a pressure line 15 into a nozzle chamber 16 of the injector 10. The injection is effected under pressure control with the aid of a spool—like valve member 17 (nozzle needle) which is axially displaceable in a guide bore and whose conical valve sealing face 18 cooperates with a valve seat face on the injector housing and thus closes the injection openings 19 provided there. Inside the nozzle chamber 16, a pressure face of the valve member 17 pointing in the opening direction of the valve member 17 is exposed to the pressure prevailing there; via an annular gap between the valve member 17 and the guide bore, the nozzle chamber 16 is continued as far as the valve sealing face 18 of the injector 10. By means of the pressure prevailing in the nozzle chamber 16, the valve member 17 that seals off the injection openings 19 is opened counter to the action of a closing force (closing spring 20), and the spring chamber 21 is pressure-relieved by means of a leakage line 22. Downstream of the distributor device 8, a check valve assembly 23 is also provided for each injector 10; this assembly admits the fuel in the direction of the injector 10 via a first check valve 24 and allows the return flow of fuel out of the injector 10 by means of a throttle 25 and a second check valve 26 for the sake of relieving the distributor device 8 and decreasing the pressure.

A preinjection at the lower fuel pressure takes place with the valve unit 12 currentless, by supplying electric current to the 3/2-way valve 7. By supplying current to the valve unit 12 as well, the main injection at the higher fuel pressure is then effected. For a postinjection at the lower fuel pressure, the valve unit 12 is switched back into the currentless state. At the end of the injection, the central valve unit 7 is switched back for leakage 27, and the distributor device 8 and the injector 10 are thus relieved. The local valve unit 11 can either be part of the injector housing or be disposed outside the injector housing. The assembly comprising the high-pressure pump 2, pressure reservoir 6 and valve unit 7 is identified overall by reference numeral 28.

Figure 1B:
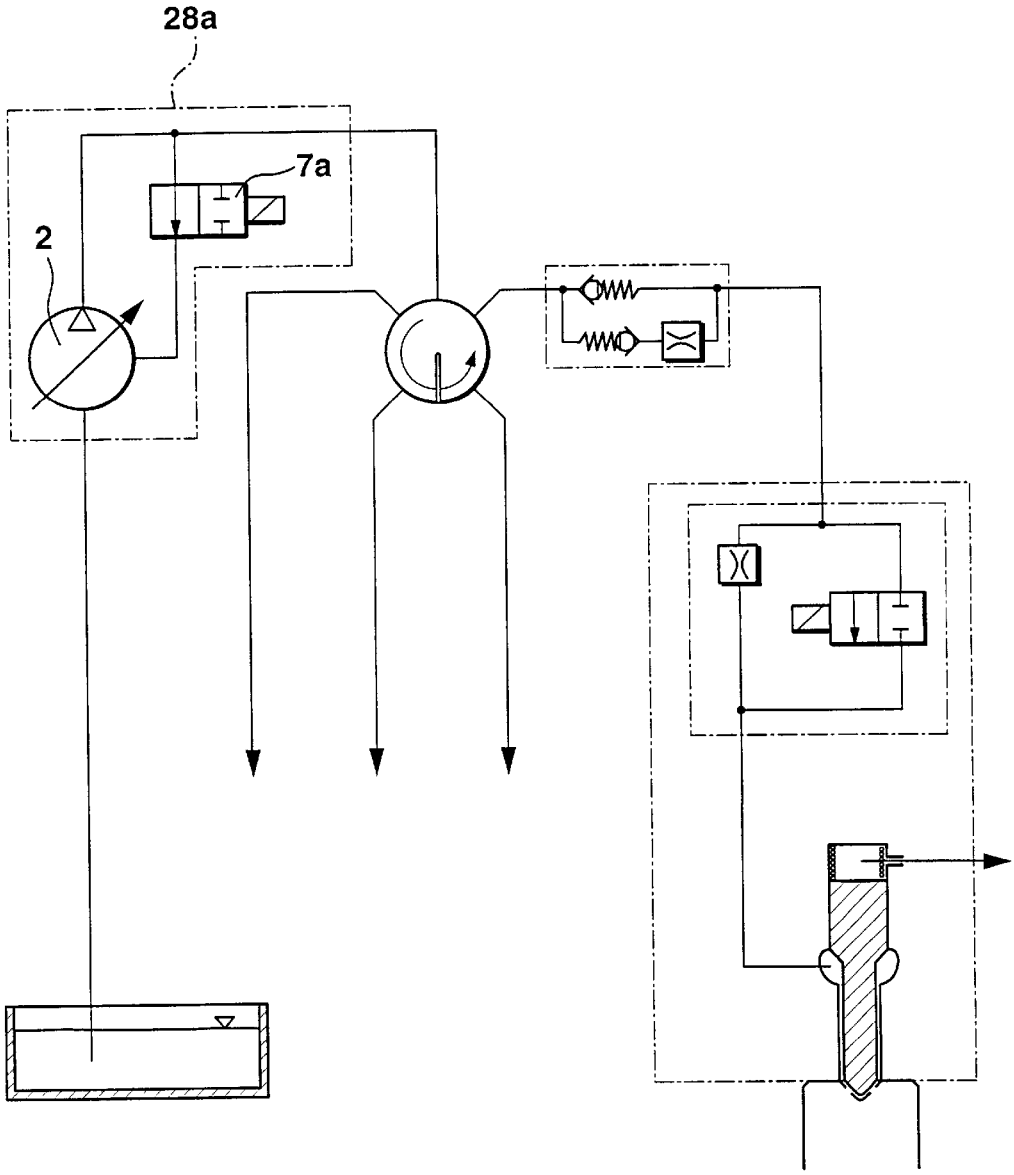

For generating high pressure, the exemplary embodiment of FIG. 1*b* uses a different assembly 28*a*, in which the central pressure reservoir of FIG. 1*a* is omitted and the higher fuel pressure is built up by supplying electric current to a 2/2-way valve 7*a*. The high pressure pump 2 can generate a fuel pressure of approximately 300 to approximately 1000 bar and can for instance be a cam pump.

Figure 2A:
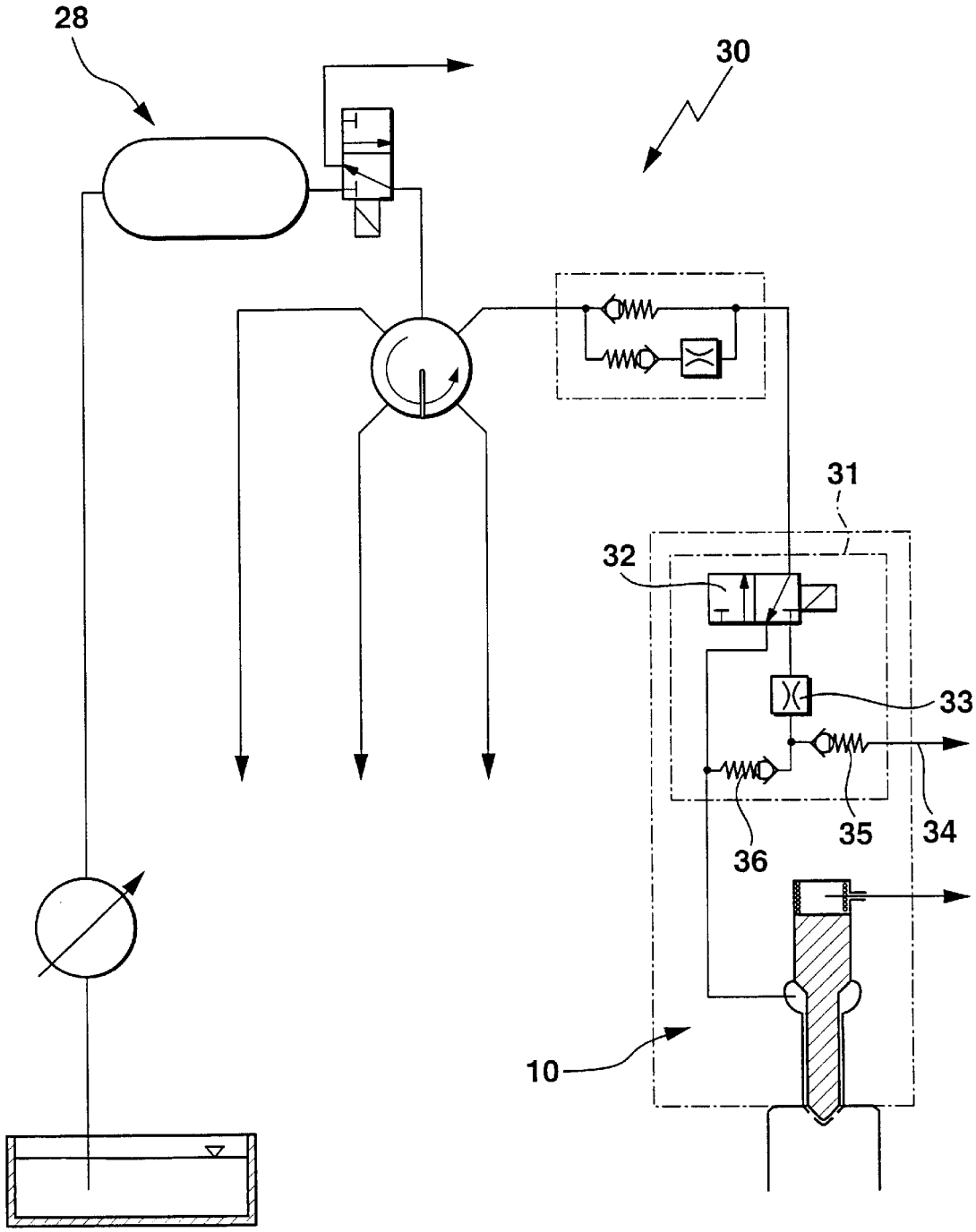
FIGS. 2*a* and 2*b* illustrate a second fuel injection system with pressure-controlled injectors and a modified locally dissipated generation of the lower fuel pressure.
Figure 2B:
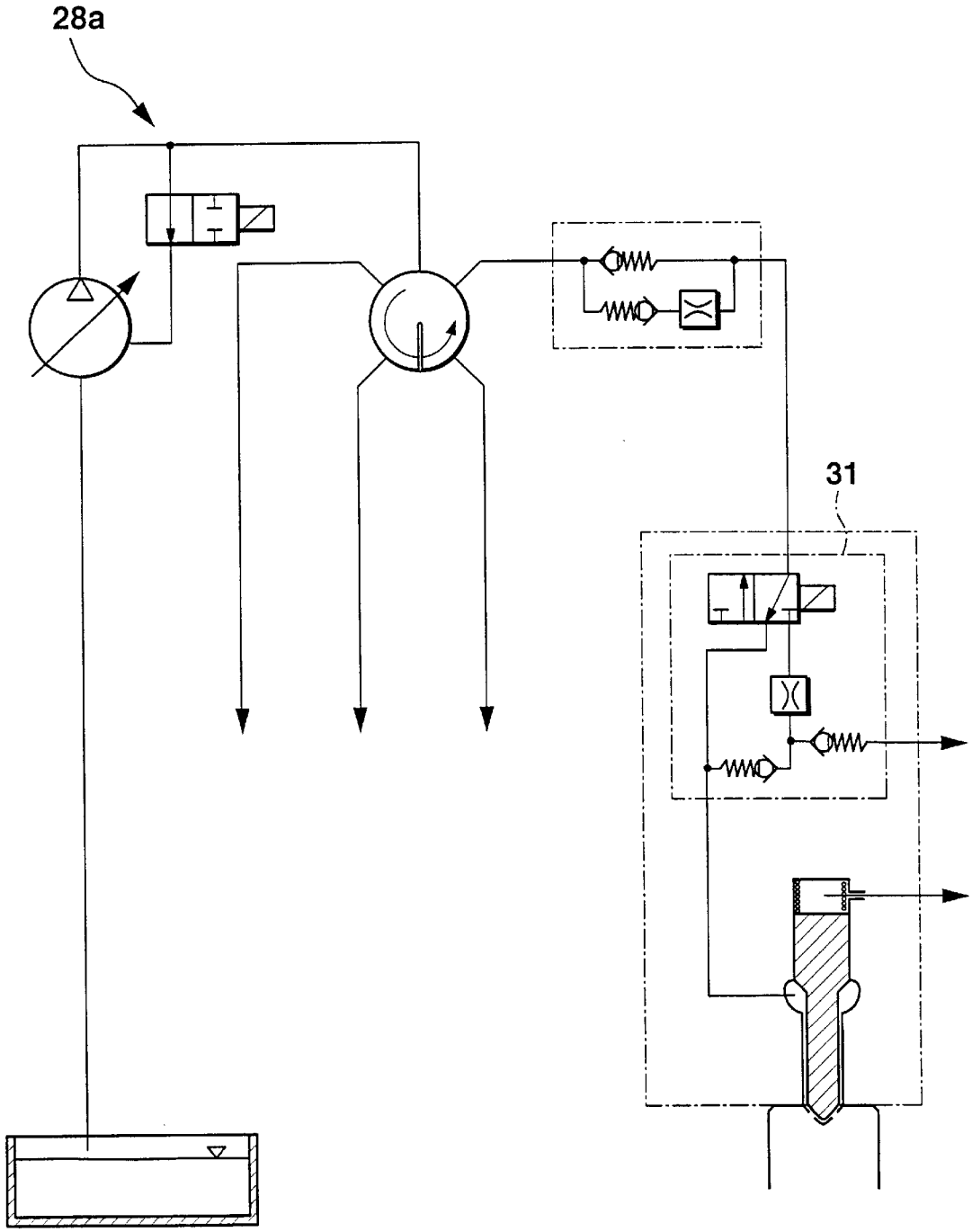

The injection system 30 shown in FIGS. 2*a* and 2*b* differs from the injection system 1 of FIG. 1*a* in having a modified local diversion unit 31. Via a valve unit (such as a 3/2-way valve) 32, the higher fuel pressure is either switched through or diverted dissipatively by means of a throttle 33 and a pressure limiting valve 35 that is set to the lower fuel pressure and communicates with a leakage line 34. Whatever pressure prevails is then carried on as in FIG. 1*a* to the injector 10; once again, a check valve 36 prevents an outflow of the higher fuel pressure via the check valve 35. The injection system of FIG. 2*a* uses the assembly 28, and the injection system of FIG. 2*b* uses the assembly 28*a*, for generating pressure.

Figure 3:
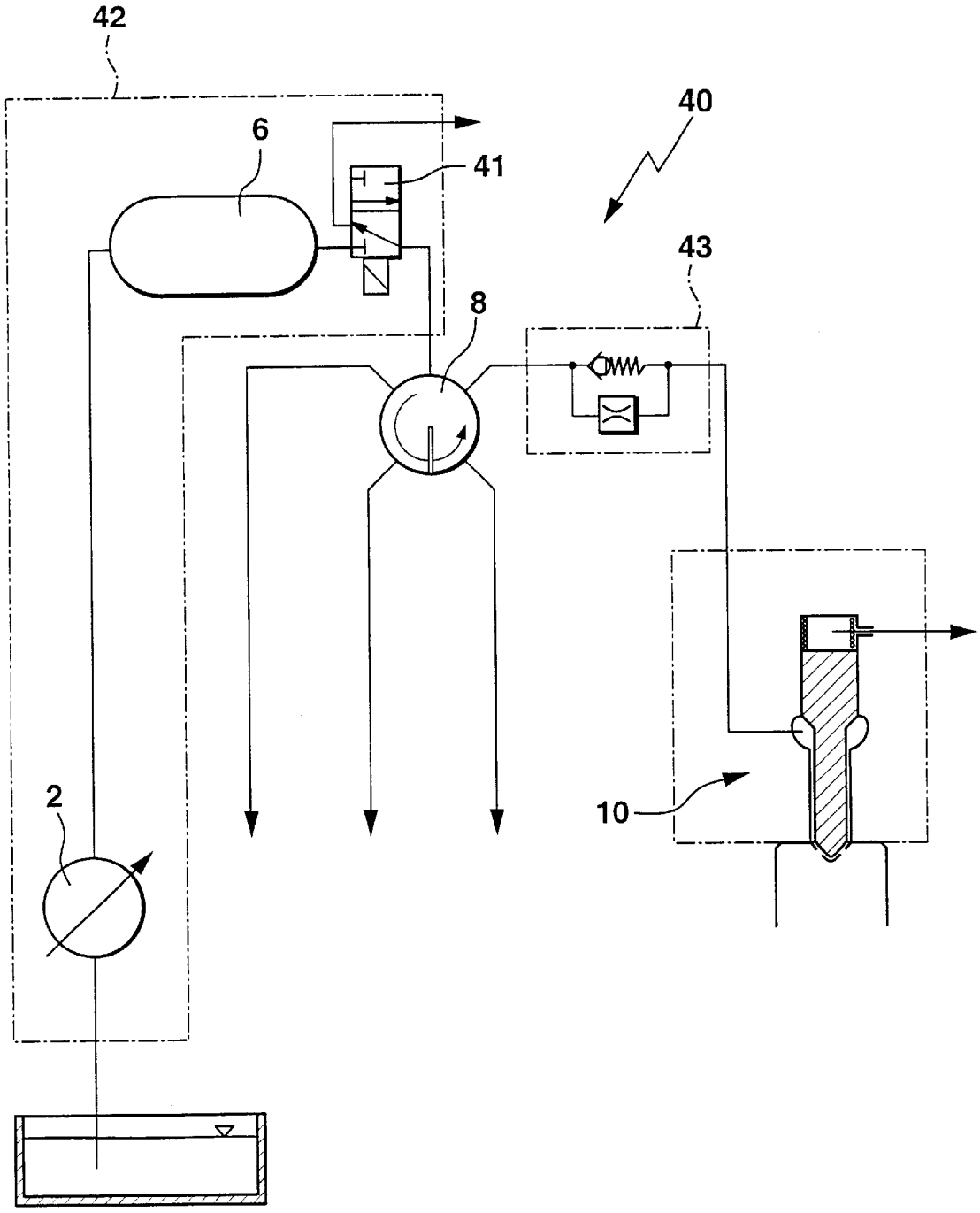
FIG. 3 shows a third injection system with pressure-controlled injectors and a central piezoelectric valve unit for shaping the fuel injection course.

In the injection system 40 shown in FIG. 3, a piezoelectric valve unit 41 is provided centrally between the pressure reservoir 6 and the distributor device 8; a cross section of the valve is controlled by means of a piezoelectric actuator. The assembly comprising the high-pressure pump 2, pressure reservoir 6 and piezoelectric valve unit 41 is identified overall by reference numeral 42. The piezoelectric actuators, which have a requisite temperature compensation and optionally a requisite step-up of force or travel, serve to control the cross section and thus the shaping of the injection course. An independent preinjection both in terms of time and injection quantity as well as injection pressure becomes possible. The main injection can be adapted flexibly to every required injection course and additionally makes a split injection or postinjection possible, which can be positioned near the main injection. Unlike the check valve assembly shown in FIGS. 1*a* and 1*b*, the second check valve is omitted from the check valve assembly 43.

Figure 4A:
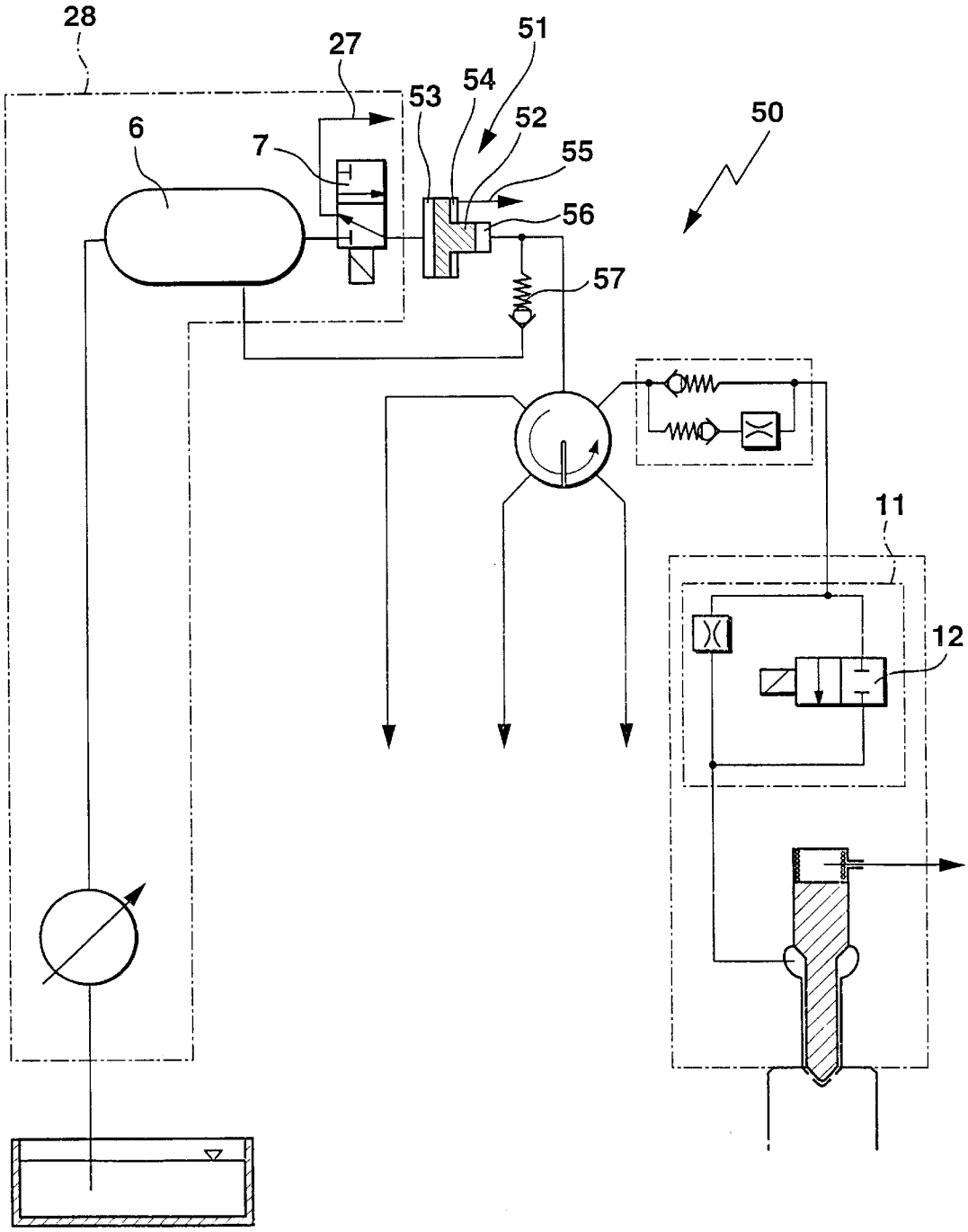
FIGS. 4*a* and 4*b* illustrate a fourth injection system with pressure-controlled injectors and a: central pressure booster and with the locally dissipated generation of the lower fuel pressure as in FIGS. 1*a* and 1*b;*
Figure 4B:
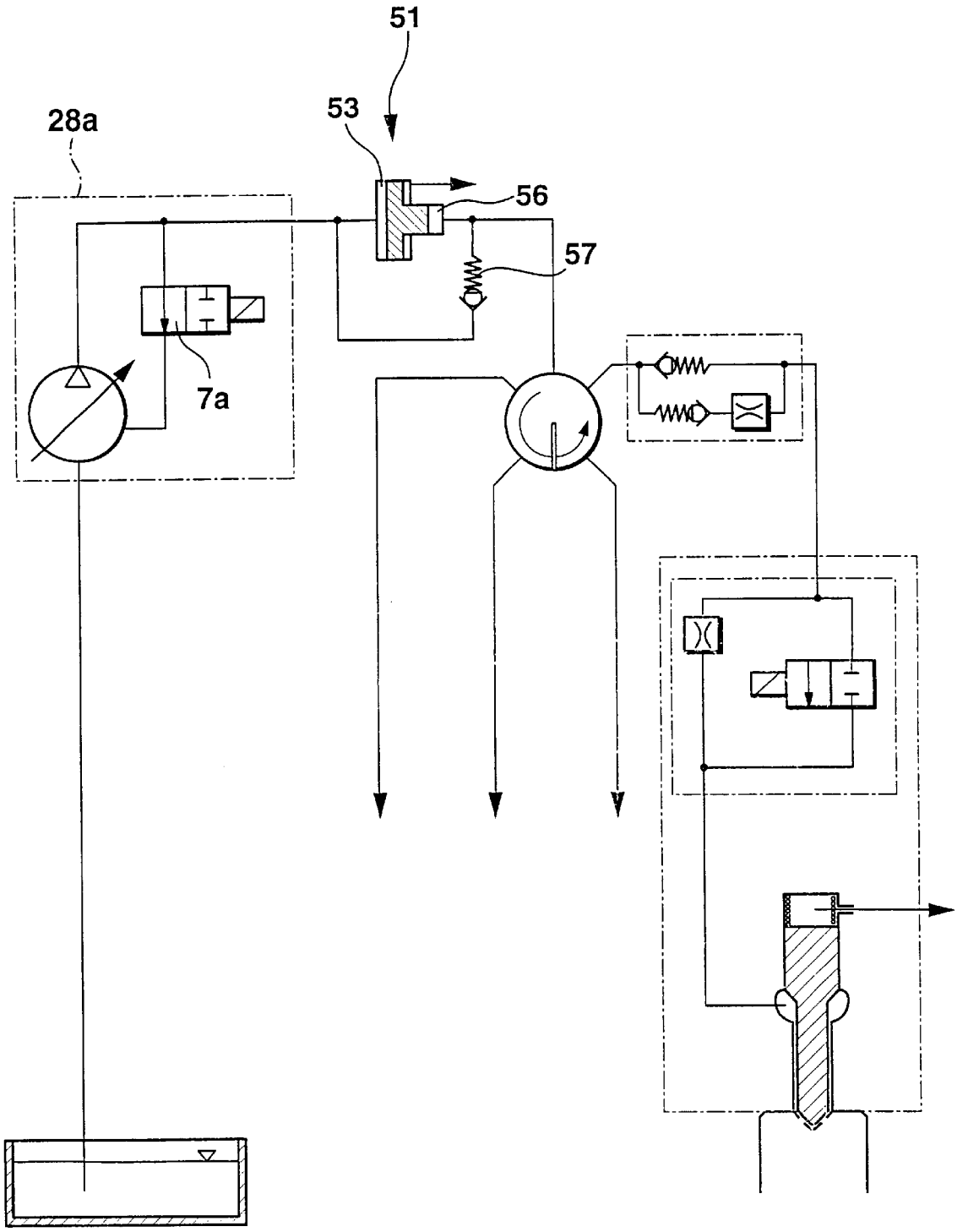

Unlike the injection system 1, in the central pressure reservoir 6 of the injection system 50 shown in FIG. 4*a*, fuel is stored at a pressure of approximately 200 to approximately 1000 bar. By means of a central pressure step-up means 51 downstream of the pressure reservoir 6, the fuel from the pressure reservoir 6 is compressed to the higher fuel pressure. The pressure step-up means 51 includes a pressure medium 52 in the form of a displaceable spool element, which can be connected at one end with the aid of the valve unit 7 to the pressure reservoir 6, so that the pressure step-up means 51 is acted upon by pressure at one end by the fuel located in a primary chamber 53. A differential chamber 54 is pressure-relieved by means of a leakage line 55, so that to reduce the volume of a pressure chamber 56, the pressure medium 52 is displaced in the compression direction. As a result, the fuel located in the pressure chamber 56 is compressed to the higher fuel pressure in accordance with the ratio of the areas of the primary chamber 53 and pressure chamber 56. If the primary chamber: 53 is connected with the aid of the valve unit 7 to the leakage line 57, then the restoration of the pressure medium 52 and the refilling of the pressure chamber 56, which is connected to the pressure reservoir 6 via a check valve 57, are effected. Because of the pressure ratios in the primary chamber 53 and the pressure chamber 56, the check valve 57 opens, so that the pressure chamber 56 is subject to the first fuel pressure (rail pressure of the pressure reservoir 6), and the pressure medium 52 is hydraulically returned to its outset position. To improve the restoration performance, one or more springs can be disposed in the chambers 53, 54 and 56. In the exemplary embodiment shown, the valve unit 7 is shown merely as an example as a 3/2-way valve. The preinjection at the lower fuel pressure is effected by supplying electric current to the valve unit 7. By supplying electric current to the valve unit 12 of the local diversion unit 11 as well, the main injection at the higher fuel pressure is then effected, while for a postinjection at the lower fuel pressure, the valve unit 12 can be switched back to the currentless state again. In the exemplary embodiment of FIG. 4*b*, in which the assembly 28*a* is provided for the high-pressure generation, the central pressure step-up means 51 is triggered via the 2/2-way valve 7*a*, and the pressure chamber 56 is made to communicate with the primary chamber 53 via the check valve 57.

Figure 5A:
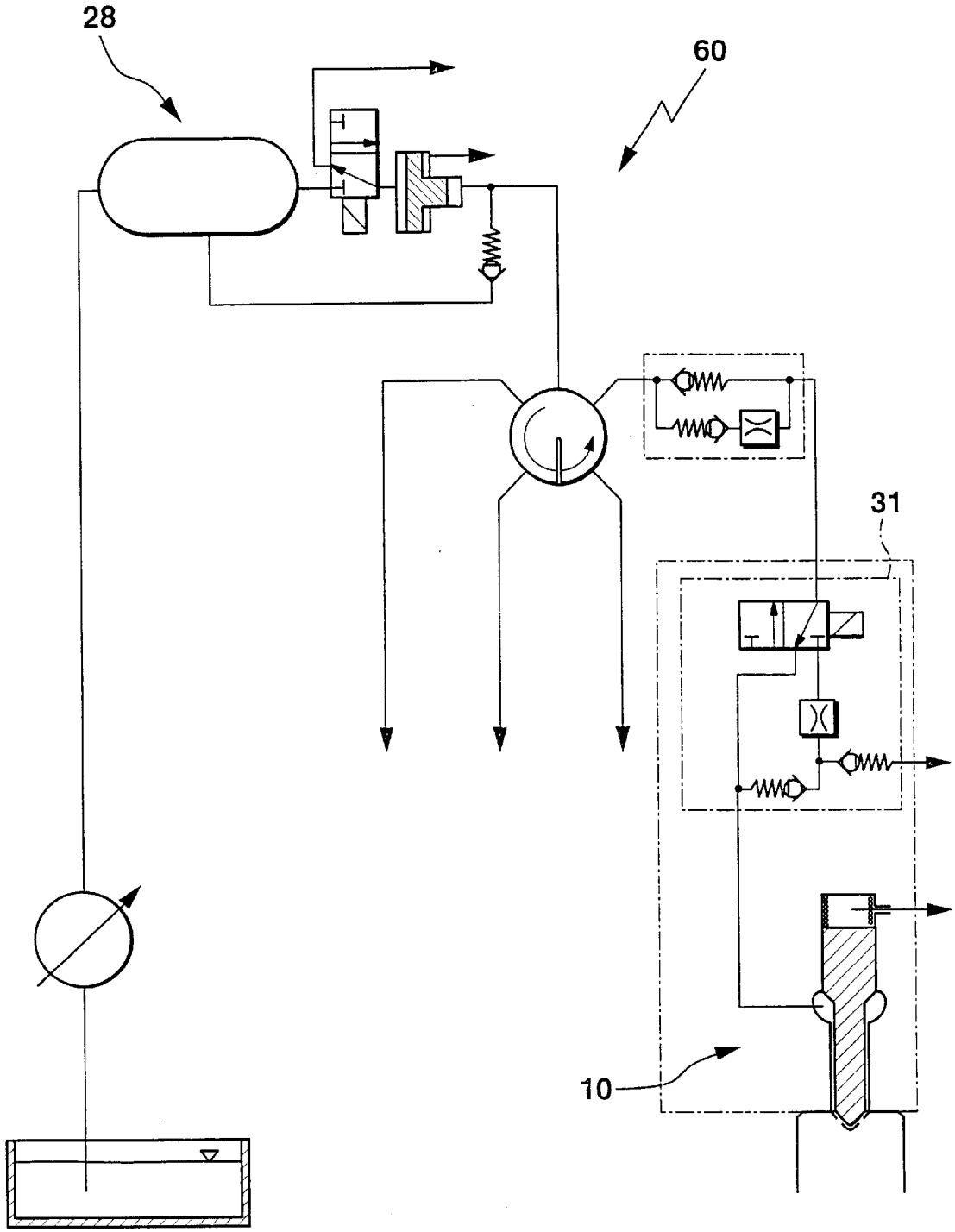
FIGS. 5*a* and 5*b* illustrate a fifth injection system with pressure-controlled injectors and a central pressure booster and with the locally dissipated generation of the lower fuel pressure as in FIGS. 2*a* and 2*b;*
Figure 5B:
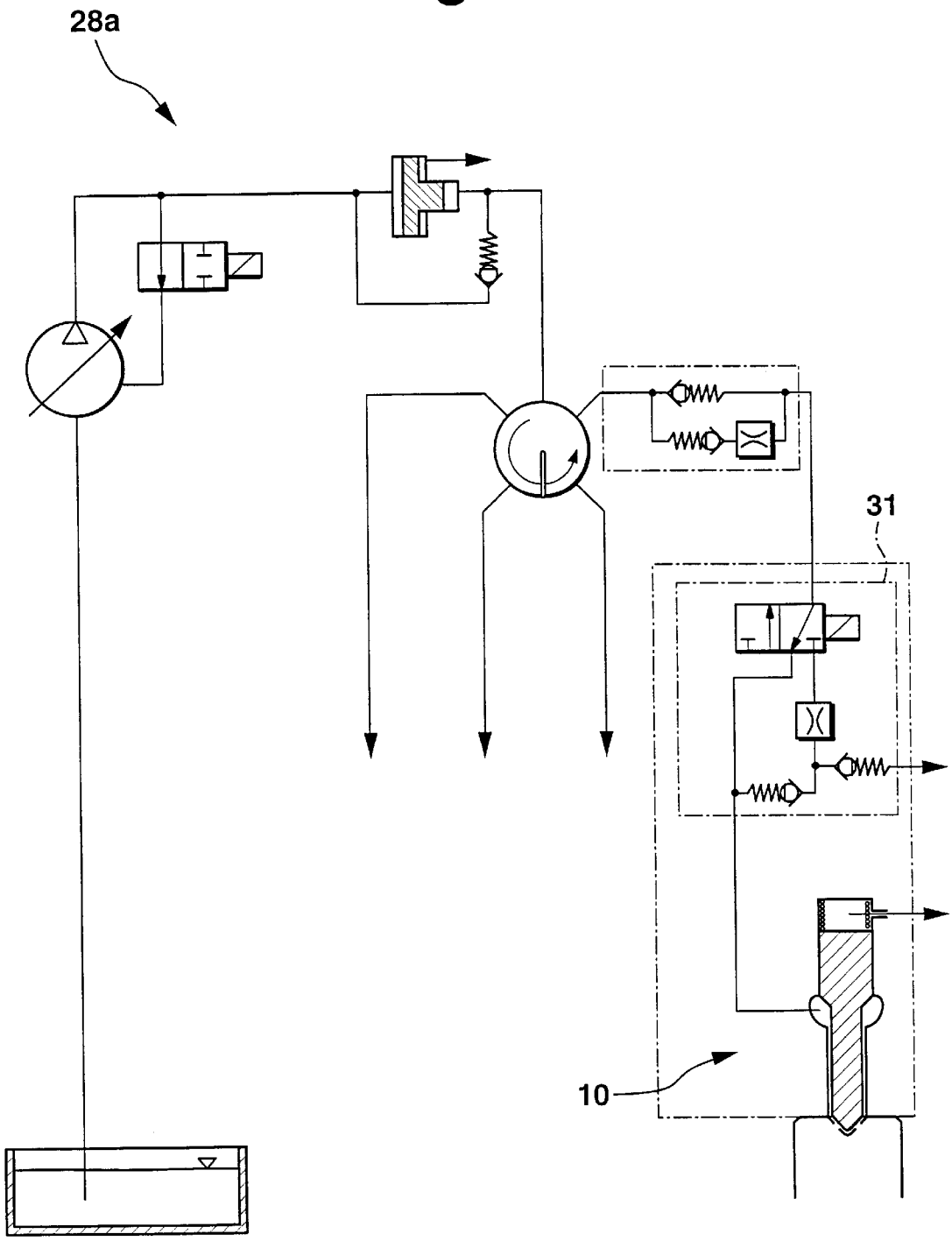

While the local diversion unit 11 is provided in the injection system 50 (FIGS. 4*a* and 4*b*), the injection system 60 shown in FIG. 5 differs in using the local diversion unit 31. For generating high pressure, the assembly 28 is provided in the injection system of FIG. 5*a*, and the assembly 28*a* is provided in the injection system of FIG. 5*b*.

Figure 6A:
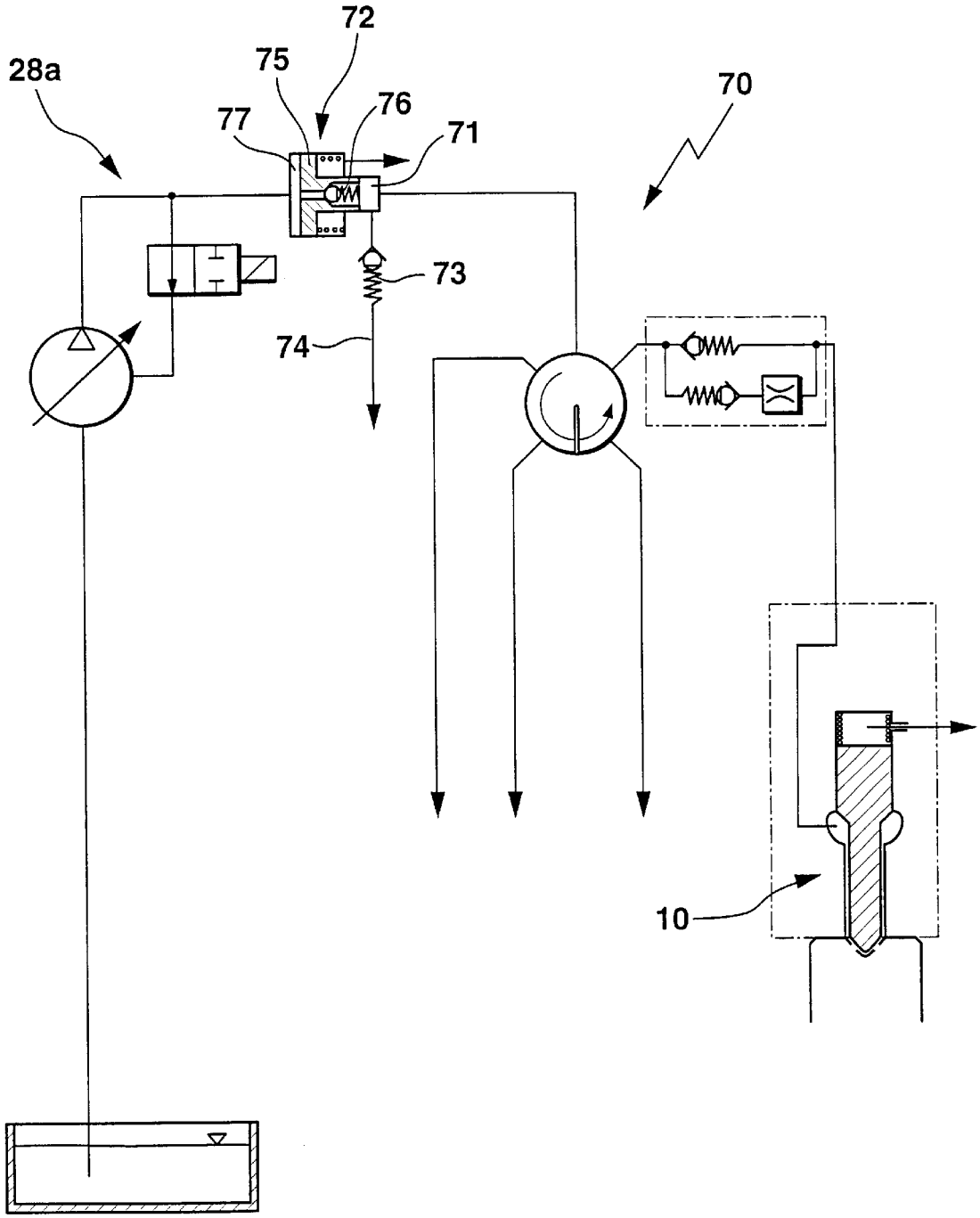
FIGS. 6*a*, 6*b* and 6*c*, shows a sixth injection system with pressure-controlled injectors and with a modified central pressure booster for a boot injection.

Unlike the injection system 60, the pressure-controlled injection system 70 of FIG. 6*a* makes do entirely without any local diversion unit. To that end, the pressure chamber 71 of the central pressure step-up means 72 is connected, via a pressure limiting valve 73 set to the lower fuel pressure, to a leakage line 74, and as a result the pressure in the pressure chamber 71 is limited initially to the lower fuel pressure, such as 300 bar. The communication between the pressure chamber 71 and the pressure limiting valve 73 is already closed, however, by the pressure medium 75 (spool element) after only a short motion of the pressure medium. Thus for the ensuing injection event, the higher fuel pressure is available. For refilling the pressure chamber 71, suitable check valves should be provided, and a spring force acting on the pressure medium 75 promotes the filling. In the exemplary embodiment shown, the pressure chamber 71 communicates with the primary chamber 77 via a check valve 76 disposed in the pressure medium 75. While in FIG. 6*a* the injection quantity that is injected at the lower fuel pressure is predetermined structurally, this injection quantity, that is, the pressure level of the preinjection and the course of the main injection (boot injection), can be controlled (FIG. 6*b*) by a central diversion unit 78 (2/2-way valve) upstream of the pressure limiting valve 73. Instead of the assembly 28*a* used in FIGS. 6*a* and 6*b*, the assembly 28 can also be used to generate high pressure.

In another variant (FIG. 6*c*), the pressure chamber 71 communicates via the line 79 directly with the pressure reservoir 6, so that its fuel is carried onward to the pressure-controlled injectors 10 for an injection at the lower fuel pressure. Thus for the ensuing injection event, the higher fuel pressure is available. The outflowing leakage quantities can be reduced as a result.

Figure 6B:
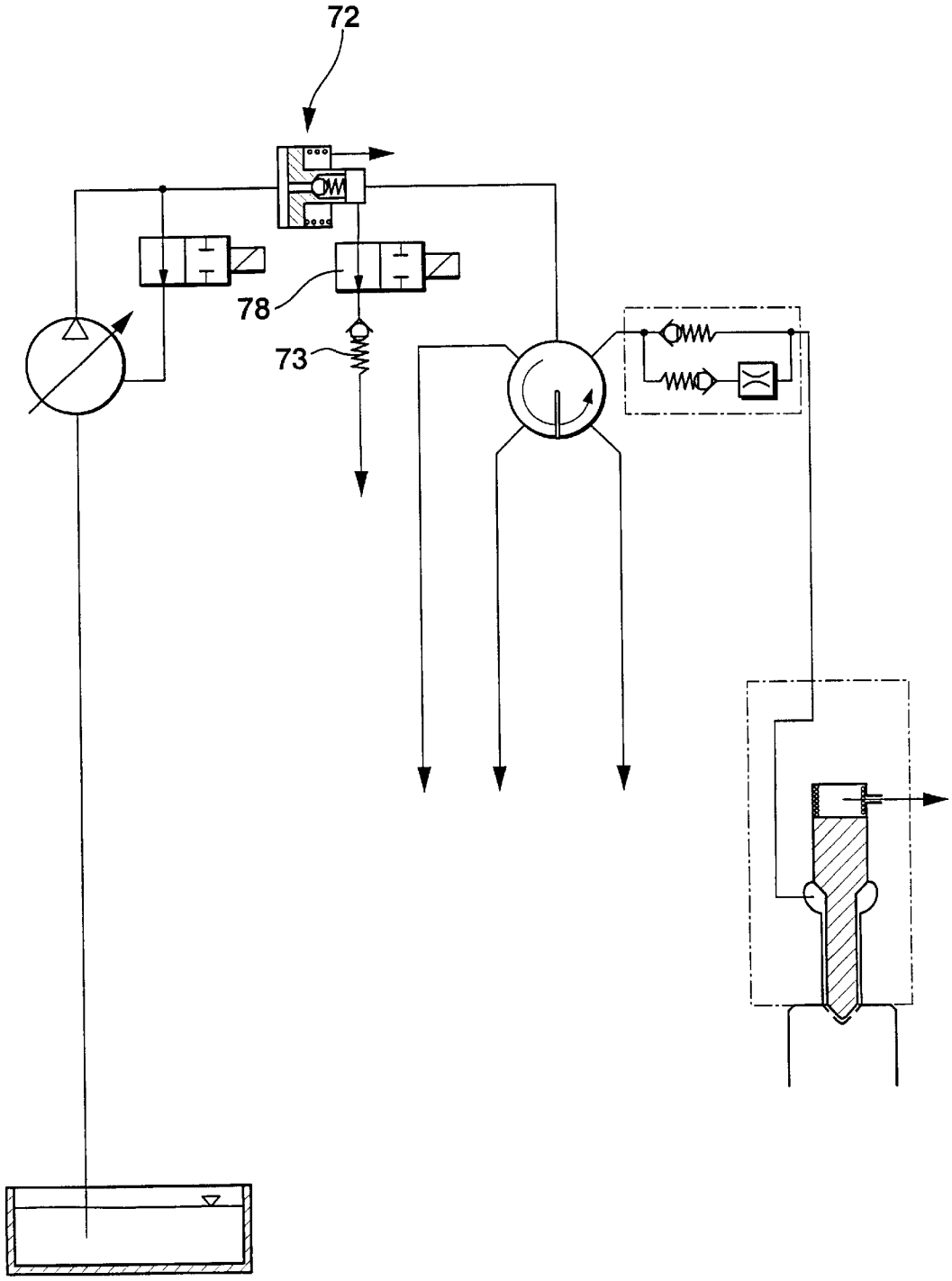
Figure 6C:
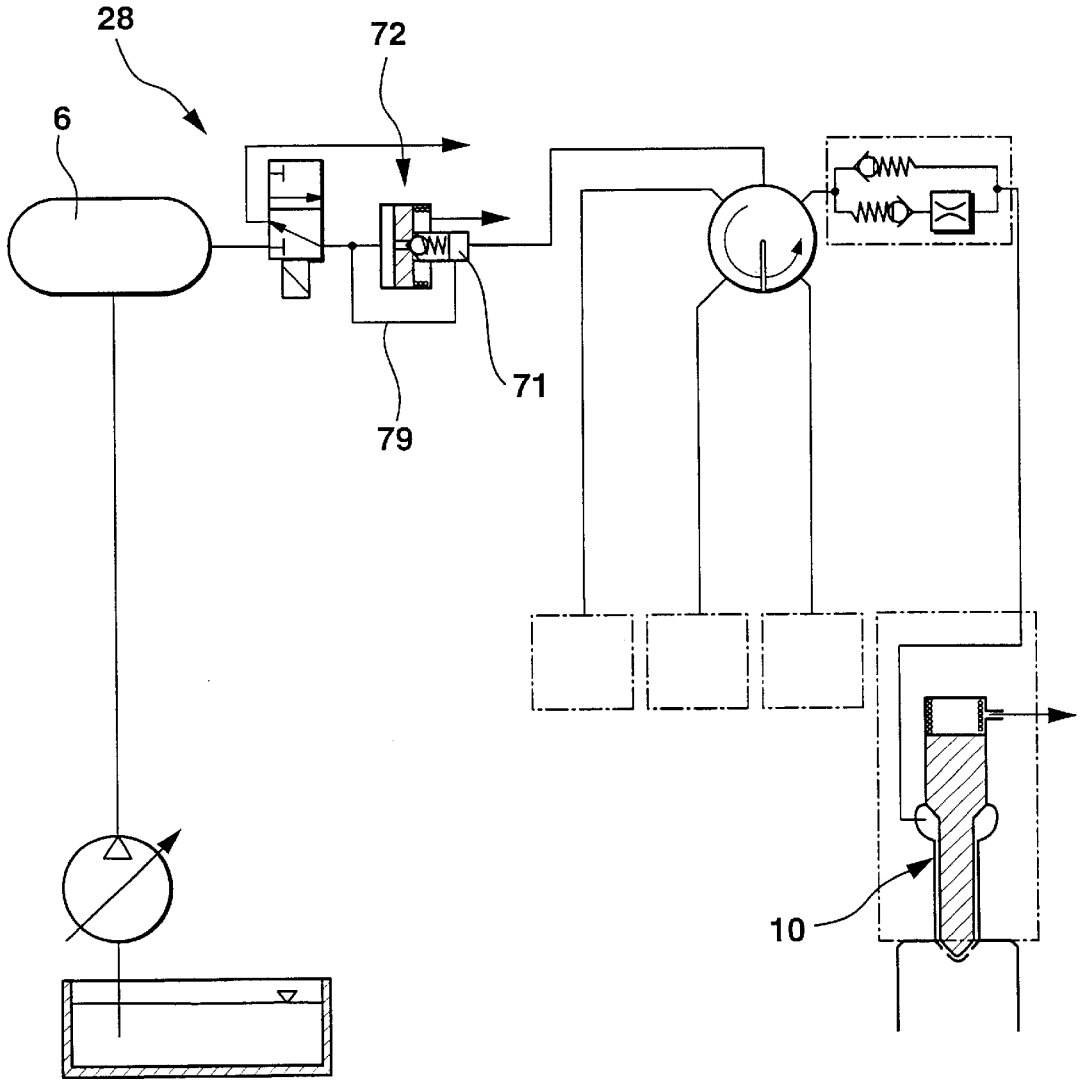
Figure 7:
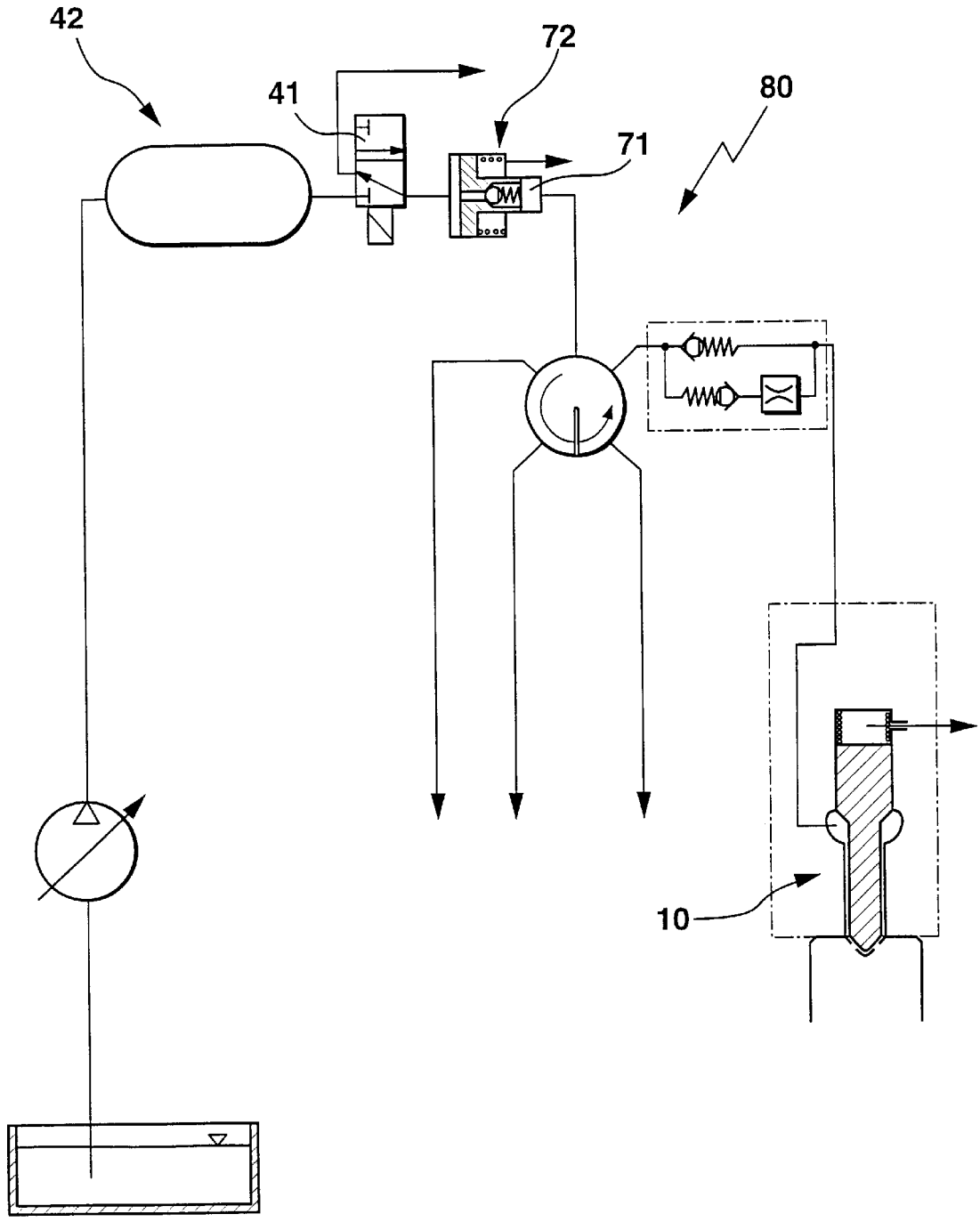
FIG. 7 shows a seventh injection system with pressure-controlled injectors and with the modified central pressure booster of FIGS. 6*a*, 6*b* and 6*c;*

Unlike FIGS. 6*a*, 6*b* and 6*c* the injection system 80 shown in FIG. 7 uses the assembly 42 (FIG. 3) and the central pressure step-up means 72 for building up pressure; the metering is effected via the piezoelectric valve unit 41. This makes a completely independent preinjection possible, both in terms of time and injection quantity and in terms of injection pressure. The main injection can be adapted entirely flexibly to any required injection course and additionally makes a split injection or postinjection possible that can be positioned virtually arbitrarily close to the main injection. Depending on the applicable opening cross section of the valve unit 41, the fuel located in the pressure chamber 71 can be compressed to a different high injection pressure and injected via the injector 10.

Figure 8A:
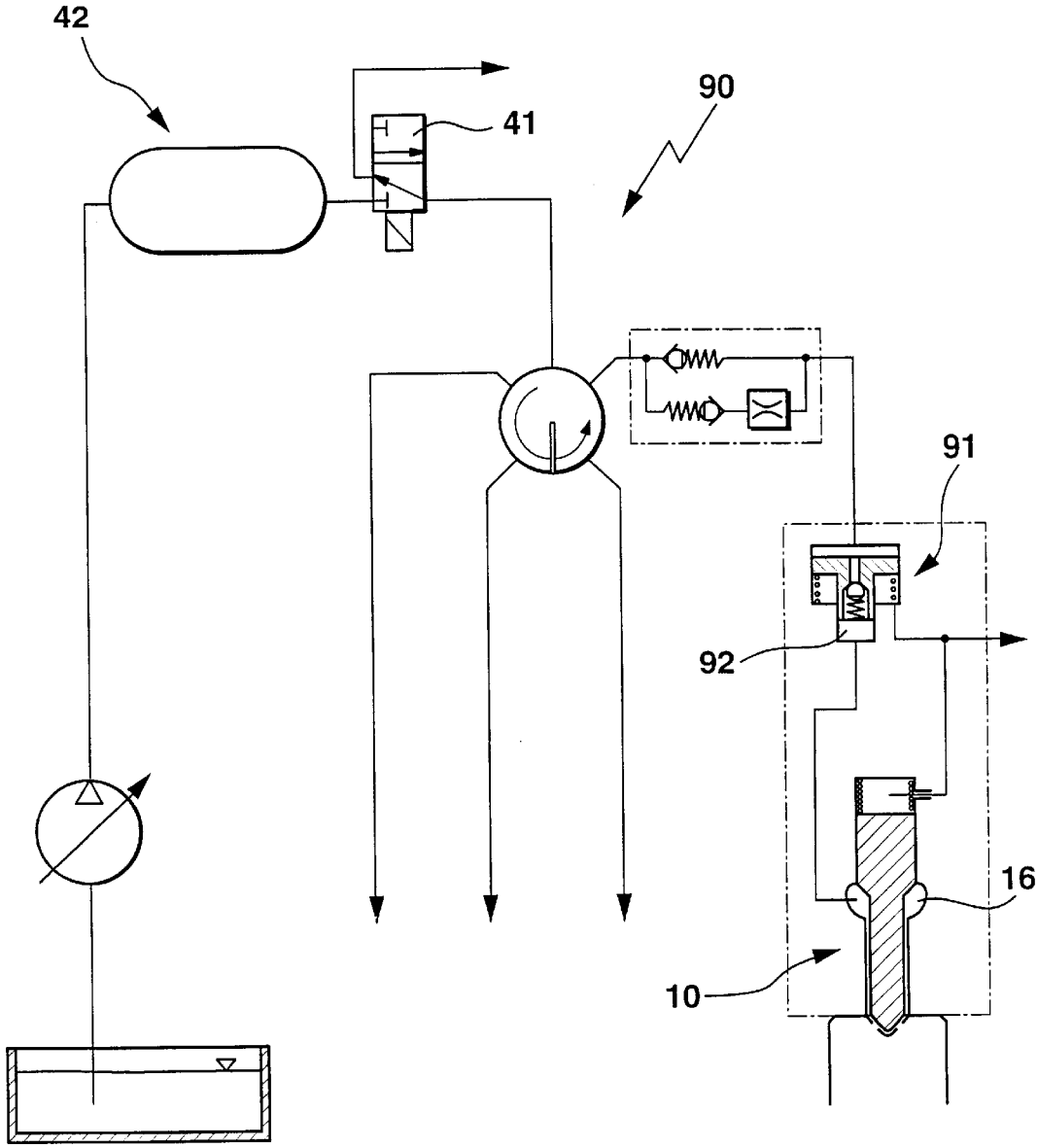
FIGS. 8*a* and 8*b* illustrate an eighth injection system with pressure-controlled injectors and with one local pressure booster for each injector.
Figure 8B:
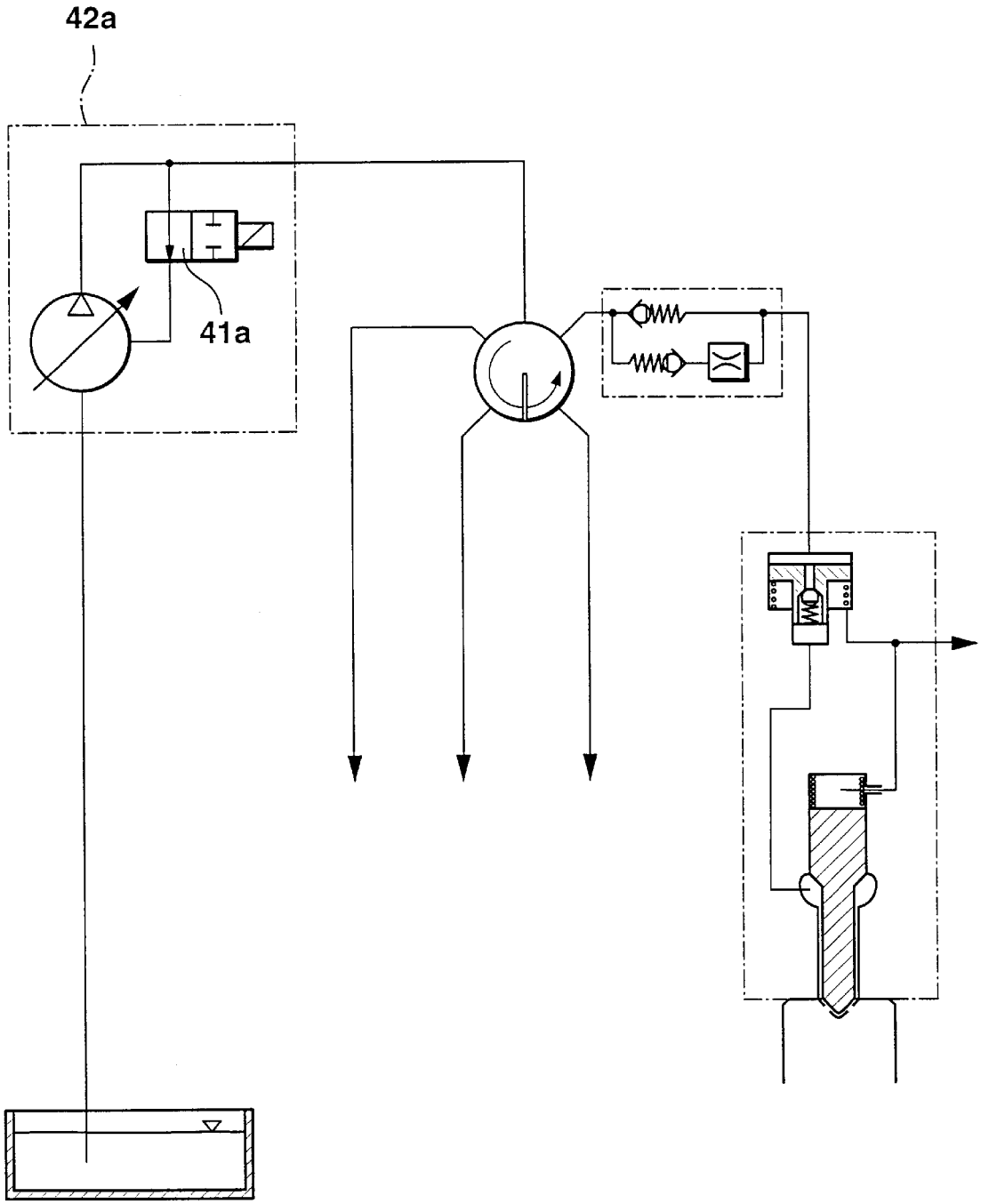

Unlike the injection system 80, in the injection system 90 shown in FIGS. 8*a* and 8*b*, one local pressure step-up means 91 is provided for each injector 10, inside each injector 10; its function is equivalent to that of the central pressure step-up means 72. The pressure chamber 92 of the local pressure step-up means 91 leads to the nozzle chamber 16 of the injector 10. The metering of the fuel pressure or the shaping of the injection course is effected in FIG. 8*a* via the piezoelectric valve unit 41 (3/2-way valve) of the assembly 42, and in FIG. 8*b* via a piezoelectric valve unit 41*a* (2/2-way valve) of the assembly 42*a*, which otherwise corresponds to the assembly 28*a*.

Figure 9A:
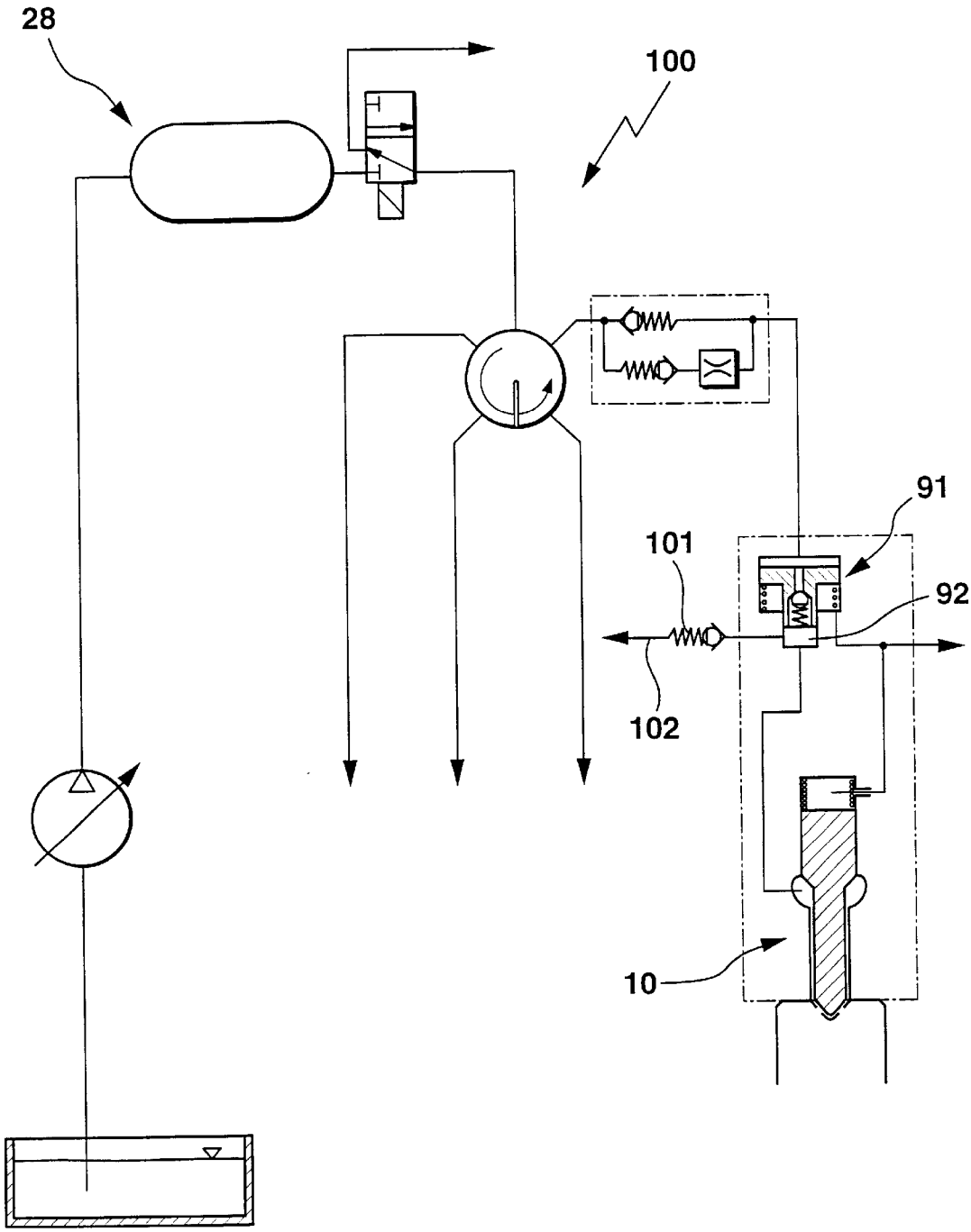
FIGS. 9*a* and 9*b* illustrate a ninth injection system with pressure-controlled injectors and with one local pressure is booster with boot injection for each injector.
Figure 9B:
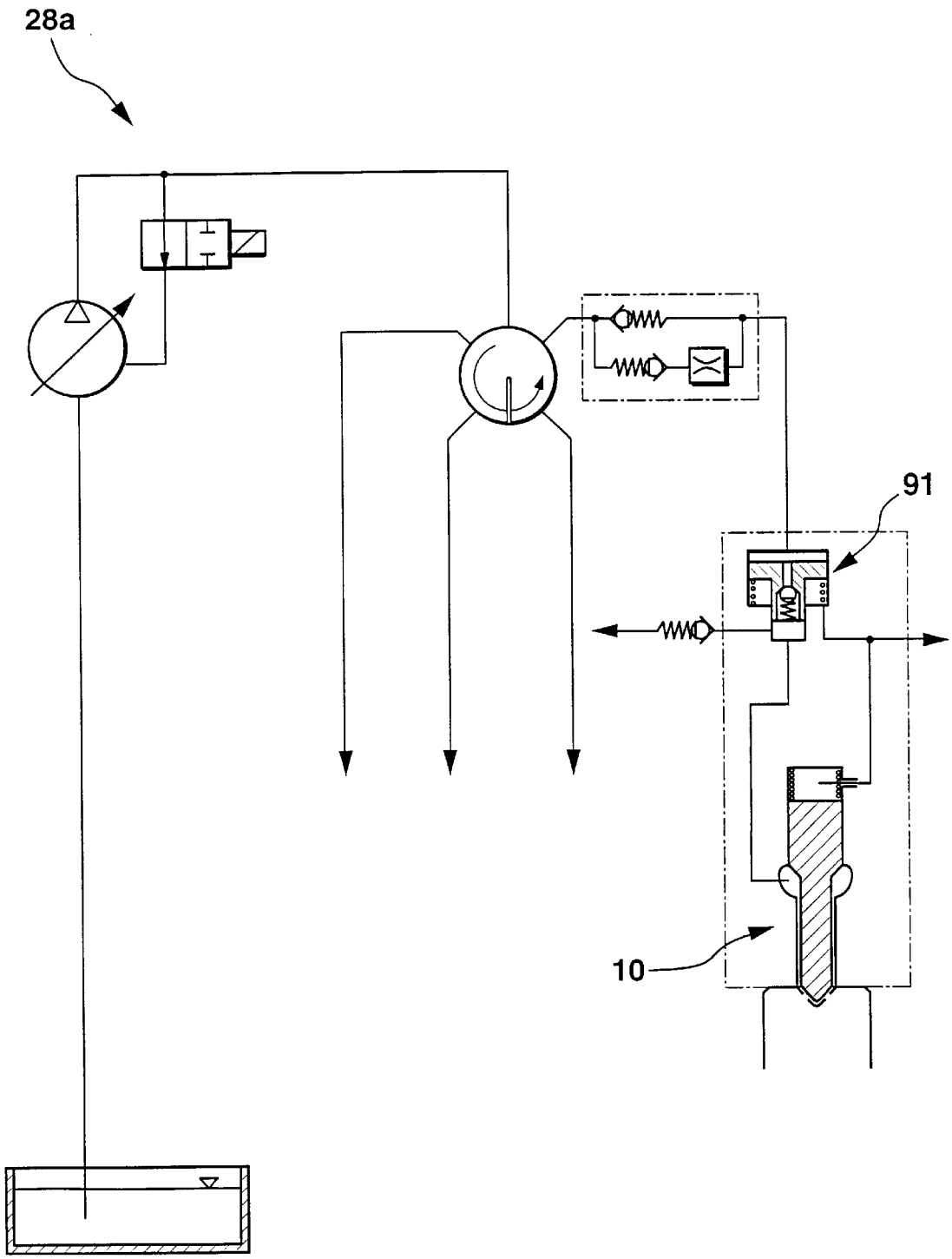

In the injection system 100 of FIGS. 9*a* and 9*b*, the pressure chamber 92 of the local pressure step-up means 91 is connected to a leakage line 102 via a pressure limiting valve 101 set to a lower fuel pressure; as a result, the pressure in the pressure chamber 92 is limited initially to the lower fuel pressure, such as 300 bar. The communication between the pressure chamber 92 and the pressure limiting valve 101 is already closed, however, by the pressure medium after only a short motion of the pressure medium (spool element). Thus for the ensuing injection event, the higher fuel pressure is available. The injection system of FIG. 9*a* uses the assembly 28, and the injection system of FIG. 9*b* uses the assembly 28*a*, for generating pressure.

Figure 10A:
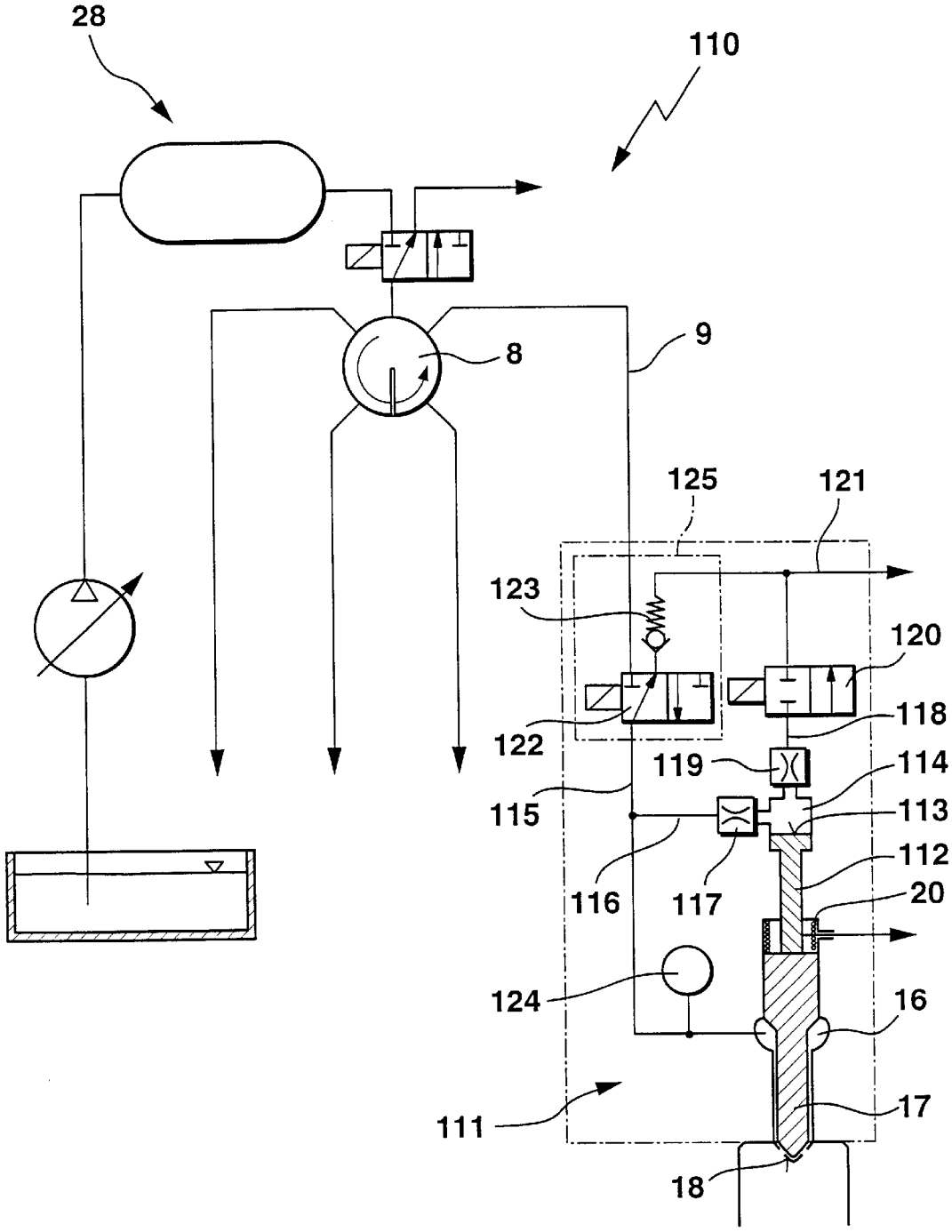
FIGS. 10*a* and 10*b*, illustrate a tenth injection system with stroke-/pressure-controlled injectors and with one local accumulator chamber for each injector.
Figure 10B:
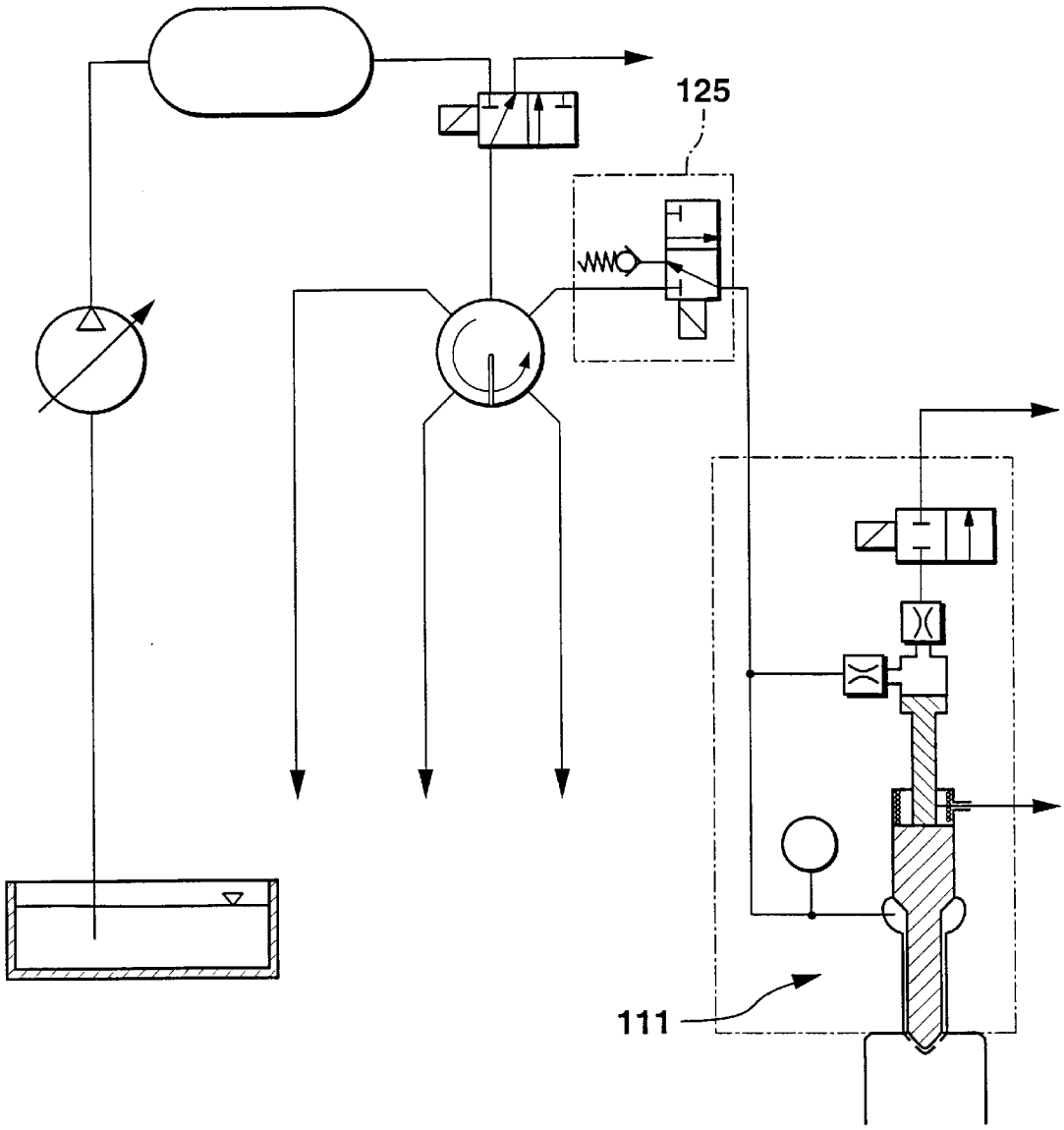

The injection system 110 shown in FIGS. 10*a* and 10*b* uses the assembly 28 to generate the higher injection pressure, which the central distributor device 8, via the pressure lines 9, distributes to the individual stroke-/pressure-controlled injectors 111. In these injectors 111, a pressure piece 112 engages the valve member 17 coaxially to the closing spring 20; with its face end 113 remote from the valve sealing face 18, this pressure face defines a control chamber 114. The control chamber 114 has a fuel inlet 116, which comes from the pressure line 115 and has a first throttle 117, and as a fuel outlet, which leads to a pressure relief line 118 and has a second throttle 119 that can be made to communicate with the leakage line 121 by means of a control device in the form of a 2/2-way valve 120. Via the pressure in the control chamber 114, the pressure piece 112 is urged in the closing direction. By actuating (supplying current to) the 2/2-way valve 120, the pressure in the control chamber 114 can be reduced, so that as a consequence the pressure in the nozzle chamber 11 acting in the opening direction on the valve member 17 exceeds the pressure that is effected in the closing direction on the valve member 17. The valve sealing face 18 lifts away from the valve seat face, so that an injection at the lower fuel pressure takes place. The process of relieving the control chamber 114 and thus controlling the stroke of the valve member 17 can be varied by way of the dimensioning of the two throttles 117, 119.

The higher fuel pressure prevailing in the pressure line 9 is carried, by supplying current to a valve unit (such as a 3/2-way valve) 122, via the pressure line 115 into the nozzle chamber 16 of the injector 111. The injection at the higher fuel pressure (main injection) takes place under pressure control. By switching the 3/2-way valve 122 over into the currentless state again, the main injection is terminated, and the pressure line 115 communicates via a pressure limiting valve 123, set to a second, lower fuel pressure (approximately 300 bar), with the leakage line 121, which serves the purpose of pressure relief. Because of the switchover, the higher pressure that initially still prevails in the pressure line 115 and the nozzle chamber 11 decreases to the lower fuel pressure, which is stored in an accumulator chamber 124 connected to the pressure line 115. This lower fuel pressure serves the purpose of preinjection and/or postinjection (HC enrichment for post-treatment of the exhaust gas). This injection is then terminated by closure of the 2/2-way valve 120. The injection at the lower system pressure can be effected either as a postinjection after the main injection or as a preinjection before the main injection. If even after a postinjection the accumulator chamber 124 is still adequately filled with fuel under pressure, then this fuel can be used in the next injection cycle for a preinjection, and as a result a preinjection and postinjection are possible for each injection cycle. The size of the accumulator chamber 124 is adapted to the requirements of the preinjection and postinjection, and the function of the accumulator chamber 124 can also be performed by a sufficiently long pressure line. The assembly identified overall by reference numeral 125 in FIG. 10 and comprising the valve unit 122 and pressure limiting valve 123 can be disposed either inside the injector housing (FIG. 10*a*) or outside it (FIG. 10*b*).

Figure 11A:
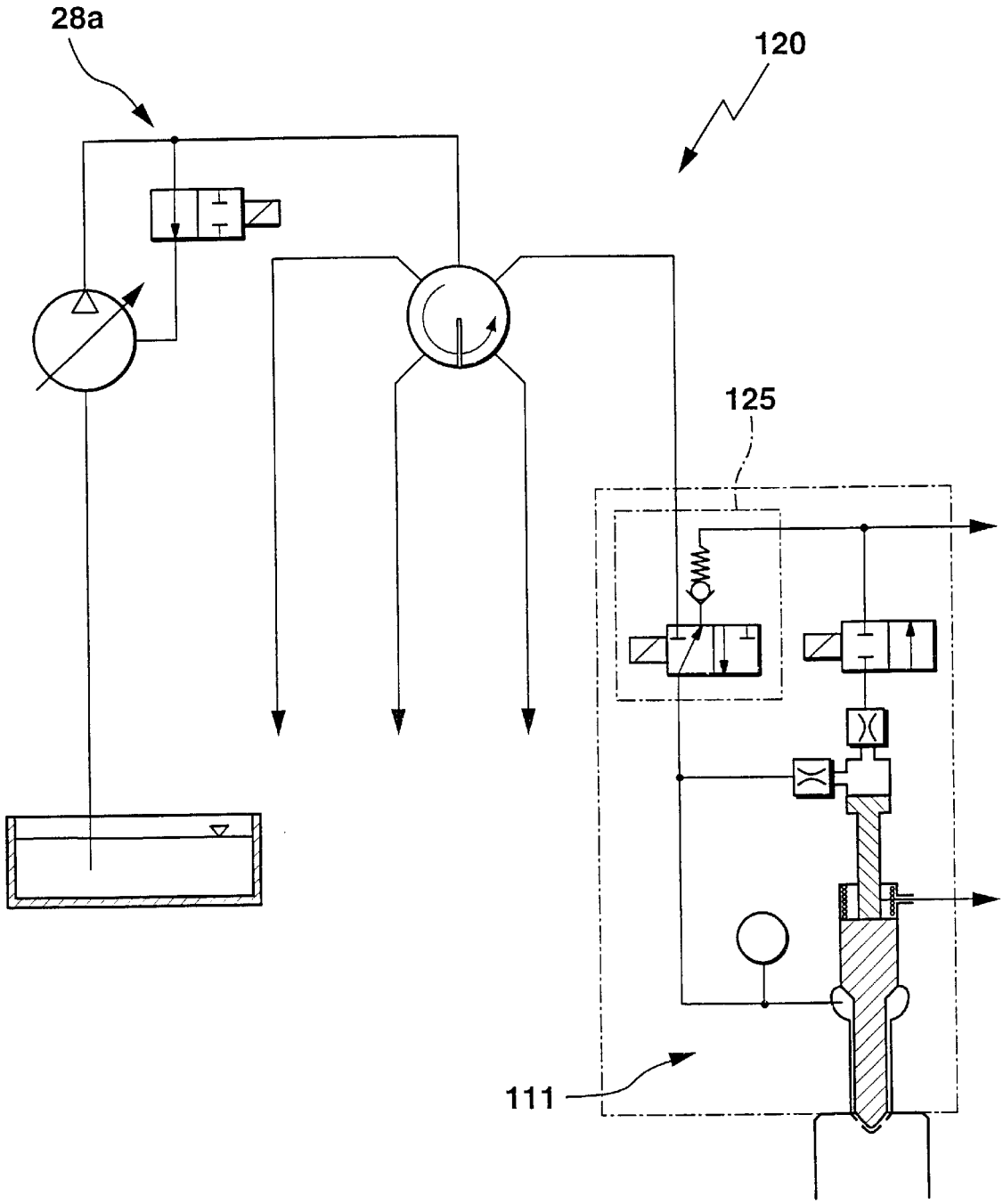
FIGS. 11*a* and 11*b* illustrate a tenth injection system with stroke-/pressure-controlled injectors and with one local accumulator chamber for each injector and a modified pressure generation.
Figure 11B:
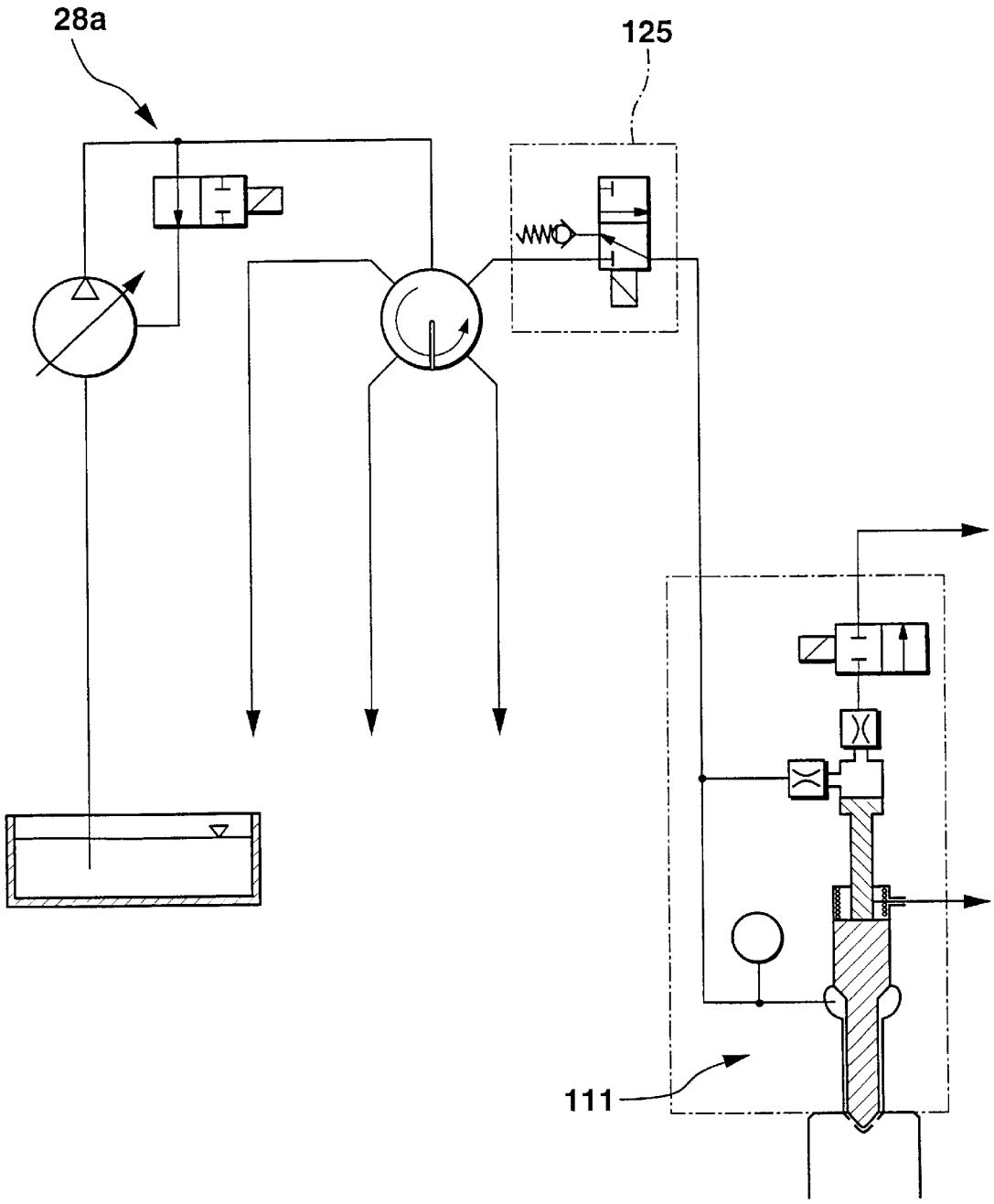

Unlike the injection system 110, the injection system 120 shown in FIG. 11 uses the assembly 28*a* for generating high pressure and has no central pressure reservoir. In FIG. 11*a*, the assembly 125 is disposed inside the housing of the injector 111, and in FIG. 11*b*, it is disposed outside this housing.

In a method for injecting fuel at at least two different high fuel pressures via injectors 10 into the combustion chamber of an internal combustion engine, in which the fuel injection at the higher fuel pressure takes place in pressure-controlled fashion, during the fuel injection, at least one lower fuel pressure is generated. To that end, a fuel injection system 1 has one local diversion unit 11 for each injector, and the diversion unit can be activated or deactivated via a valve unit.

The foregoing relates to preferred exemplary embodiments of the invention, it being understood that other variants and embodiments thereof are possible within the spirit and scope of the invention, the latter being defined by the appended claims.

We claim:

1. A fuel injection system (1) for an internal combustion engine, in which fuel is injected into the combustion chamber of the engine at at least two different high fuel pressures via injectors (10), wherein fuel is supplied directly from a fuel pump to each injector at the higher of the two pressures, and each injector (10) has a fuel line (15) for the fuel to be injected and a local diversion unit (11) located in the fuel line (15), which local diversion unit is activatable via a valve unit (12) to generate the lower of the two high pressures from the higher pressure within the local diversion unit, so that fuel is supplied to each injector at the higher of the two high pressures when the diversion unit is not activated, and at the lower of the two high pressures when the diversion unit is activated.

2. The fuel injection system according to claim 1, in which the local diversion unit (11 ) has a throttle (13).

3. The fuel injection system according to claim 1, in which the local diversion unit (31; 125) has a pressure limiting valve (35; 123) set to the lower fuel pressure.

4. The fuel injection system according to claim 2, in which the local diversion unit (31; 125) has a pressure limiting valve (35; 123) set to the lower fuel pressure.

5. The fuel injection system according to claim 1, in which the injection at the fuel pressures takes place by pressure-controlled means in each case.

6. The fuel injection system according to claim 2, in which the injection at the fuel pressures takes place by pressure-controlled means in each case.

7. The fuel injection system according to claim 3, in which the injection at the higher and the lower fuel pressure takes place by pressure-controlled means in each case.

8. The fuel injection system according to claim 1, in which the injection at the higher fuel pressure takes place by pressure-controlled means, and the injection at the lower fuel pressure takes place by a stroke-controlled means.

9. The fuel injection system according to claim 2, in which the injection at the higher fuel pressure takes place by pressure-controlled means, and the injection at the lower fuel pressure takes place by a stroke-controlled means.

10. The fuel injection system according to claim 3, in which the injection at the higher fuel pressure takes place by pressure-controlled means, and the injection at the lower fuel pressure takes place by a stroke-controlled means.

11. The fuel injection system according to claim 8, in which for each injector (111), one local accumulator chamber (124) is provided, in which the lower fuel pressure is stored.

12. The fuel injection system (40; 80; 90) with pressure-controlled injectors (10), as defined by claim 1, in which a piezoelectric valve unit (41;41*a* ), with a controllable valve cross section is provided centrally in the pressure line leading to the injectors (10).

13. The fuel injection system according to claim 1, which includes a central distributor device (8), which distributes the fuel to the individual injectors (10).

14. The fuel injection, system according to claim 2, which includes a central distributor device (8), which distributes the fuel to the individual injectors (10).

* * * * *